US006318594B1

(12) United States Patent
Hutchins

(10) Patent No.: US 6,318,594 B1
(45) Date of Patent: Nov. 20, 2001

(54) CONTAINER SYSTEM AND METHOD APPARATUS FOR HOLDING AND DISPENSING FLOWABLE DRY GOODS

(76) Inventor: Burleigh M. Hutchins, 153 North St., Upton, MA (US) 01568

( * ) Notice: Subject to any disclaimer, the term of this patent is extended or adjusted under 35 U.S.C. 154(b) by 0 days.

(21) Appl. No.: 09/566,594

(22) Filed: May 8, 2000

(51) Int. Cl.[7] ..... B67D 3/00

(52) U.S. Cl. ..... 222/1; 222/185.1; 222/181.2; 222/105; 222/530

(58) Field of Search ..... 222/1, 185.1, 181.2, 222/181.3, 162, 163, 160, 95, 105, 608, 528, 530; 414/411, 412

(56) References Cited

U.S. PATENT DOCUMENTS 4,365,737 * 12/1982 Marvia ..... 229/122
4,572,408 * 2/1986 Kupersmit ..... 222/153.14
4,573,204 * 2/1986 Polett ..... 383/41
5,335,820 8/1994 Christianson .
5,340,218 8/1994 Cuthbertson .
5,344,048 9/1994 Bonerb .
5,636,764 6/1997 Bonerb .
5,685,454 11/1997 Bonerb .
5,687,881 * 11/1997 Rouse et al. ..... 222/185.1

FOREIGN PATENT DOCUMENTS

2078676-A * 1/1982 (GB) ..... B65D/83/06

* cited by examiner

*Primary Examiner*—Kevin Shaver
*Assistant Examiner*—Patrick Buechner
(74) *Attorney, Agent, or Firm*—John E. Toupal; Harold G. Jarcho

(57) ABSTRACT

A soft container and handling system for transporting, handling, and dispensing flowable dry goods, the container having a resealable discharge chute extending from a bottom wall portion and arranged to allow gravity induced discharge of goods when raised above a surface and to be closed against an upper portion of the container to prevent flow with the container supported on the surface.

36 Claims, 25 Drawing Sheets

CONTAINER SYSTEM AND METHOD APPARATUS FOR HOLDING AND DISPENSING FLOWABLE DRY GOODS

FIELD OF THE INVENTION

The present invention relates to a container and system for handling, storing, and discharging flowable dry materials.

BACKGROUND OF THE INVENTION

It has recently become common to handle, store and dispense flowable dry goods, such as agricultural feed, plastic molding resins, dry chemicals, and many dry food products, in large soft containers. A typical container of this type has a capacity of approximately one ton, and dimensions of approximately four feet by four feet by four feet. These dimensions allow the containers to be transported and stored on standard pallets.

The ease, convenience, and flexibility of using such containers make them most practical and desirable to medium sized processors, for whom small fifty-pound bags of goods are burdensome and not economical. For such users, the purchase of goods in truckloads and the storage in silos is also not feasible, but such containers as are the subject herein still allow the processor to purchase goods "by the ton" as opposed to "by the pound", so that a significant bulk discount can be realized. The ability to store many of these containers in a relatively small area allows the processor to inventory many types of goods simultaneously and access each on short notice.

Additionally, these reinforced fabric bag-like containers are reusable many times, offering the processor a significant savings over disposable paper bags or Gaylord boxes, which are generally only reusable once or twice.

These containers are filled through the top, and goods are generally dispensed through openings in a side or in the bottom through a variety of methods and means. They are these methods and means of dispensing which to date have been the most troublesome aspects of prior art soft storage containers.

Some materials just do not flow as well as others and are inherently more suitable to bottom discharge containers while other materials are very fluid or hazardous and more suitable to side discharge containers.

During transporting from the vendor to the customer, and over time, some dry goods can become compacted. As a result, they cake and clump and become not readily flowable. Vibrators are sometimes employed to reduce clumping and improve flow, but this is quite burdensome and complicated and adds an additional expense.

Precise and simple control of the flow rate of materials of varying viscosities is not provided and automatic control of flow rate and the termination of discharge is not provided in present systems.

Precise control and measurement of the amount of material which has been dispensed, such as by weight, is not provided in present systems.

To date, there are no known re-usable soft containers or dispensing systems which provide a means for an individual operator to conveniently handle bulk quantities of dry goods, to move the goods freely about a warehouse, to position the goods precisely where and as needed, to dispense the goods precisely and with minimal loss, and to reseal and restore the containers.

SUMMARY OF THE INVENTION

The present invention is a soft dry goods container and dispenser and a handling system therefor.

The container comprises a substantially planar top, front, back, left side, right side, and bottom panels, arranged in an orthogonal hexahedron. The panels are constructed of a durable and flexible fabric and, therefore, the containers are inherently collapsible when empty. The top panel has an inlet opening through which the container is filled with the flowable dry goods. The container is adapted to contain the dry goods and to dispense the same through a resealable discharge chute that is provided along the edge formed by the bottom and front panels. The system comprises means for transporting and supporting the container, means for lifting and lowering the container to allow the goods to automatically flow from the open chute in a precisely controllable manner and by only the force of gravity, means for pinching the chute closed as the container is lowered, means for distorting the container to force all of the goods therefrom, and means for precisely maneuvering and locating the container and system.

Both the container and the system are adapted to allow an individual to conveniently and effectively handle and dispense dry goods without assistance.

OBJECTS OF THE INVENTION

It is the primary object of the present invention to provide a dry goods container, and a handling and dispensing system therefor, that are more efficient and effective than existing containers and systems.

It is another object of the invention to provide a container and system that can be operated by an individual user.

It is still another object of the invention to provide a container and system that allow a more efficient material discharge. It is still another object of the invention to provide a container and system that allow a more controllable discharge of the goods.

It is still another object of the invention to provide a container and system that reduce the problems created by the compacting and caking of the goods before or during discharge without the use of vibrators or such.

It is a further object to provide an edge-discharge soft container and a handling system.

It is another object of the invention to provide a container with an edge-discharge spout that can be accessed from the front.

It is another object of the invention to provide an edge-discharge container including an adjustable flap that maintains the shape and integrity of the container before initial discharge and after partial discharge.

These and other objects will be apparent from the description and claims that follow.

DETAILED DESCRIPTION OF THE PREFERRED EMBODIMENT

Figure 1A:
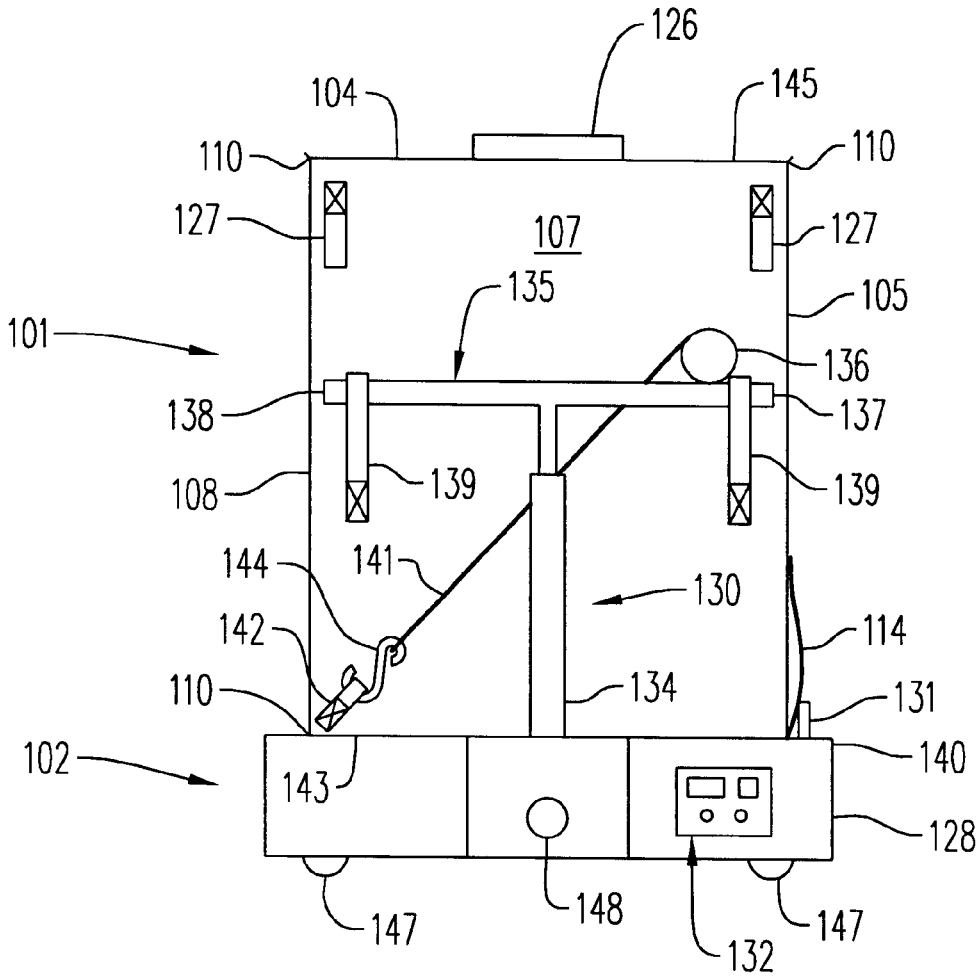
FIG. 1A is a side view of a container and system according to the preferred embodiment of the invention in the pre-dispensing condition.
Figure 1B:
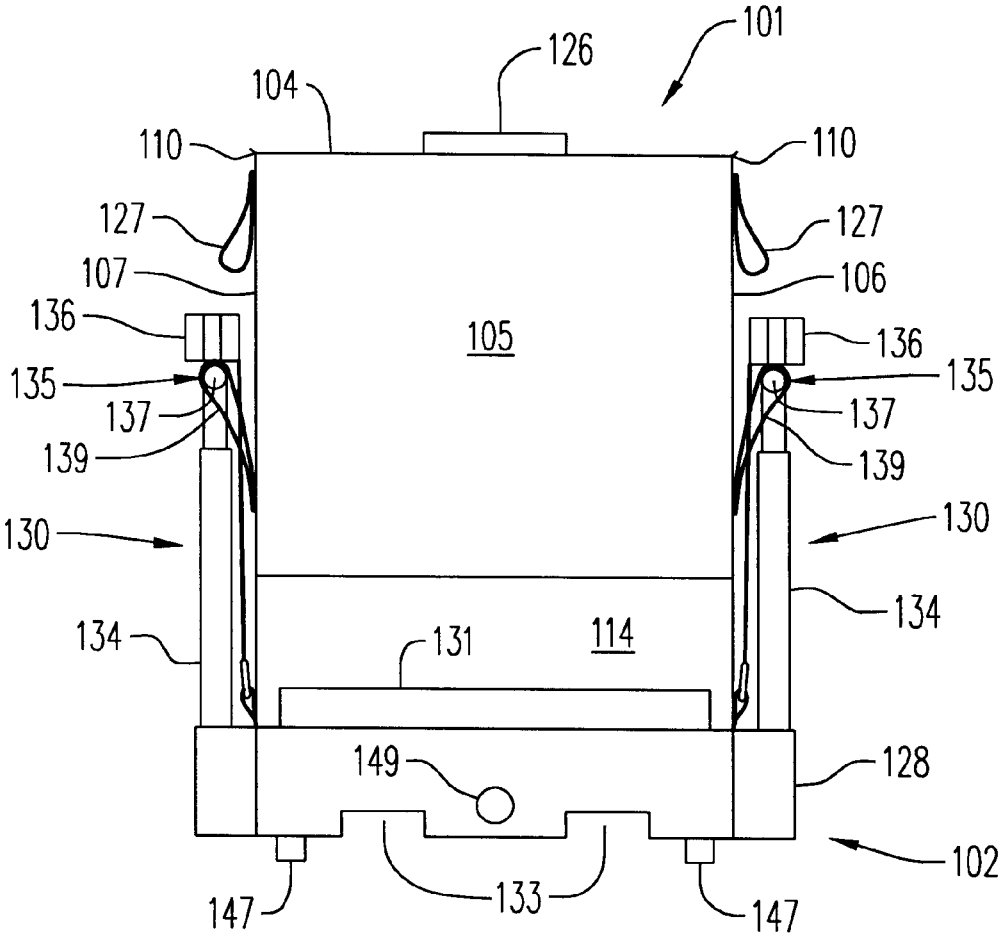
FIG. 1B is a front view of the container and system of FIG. 1A invention in the pre-dispensing condition.
Figure 1C:
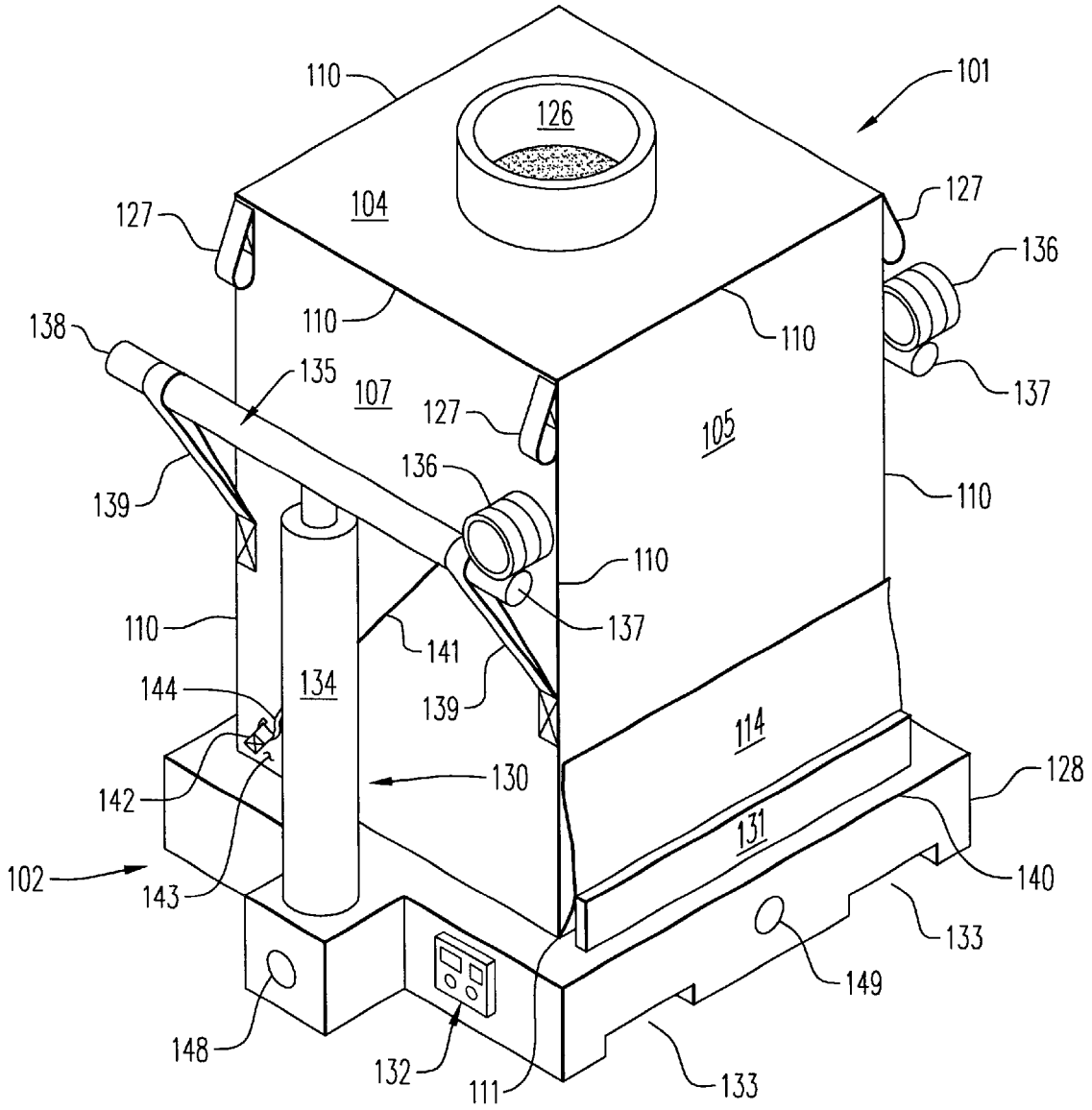
FIG. 1C is a perspective view of the container and system of FIG. 1A in the pre-dispensing condition.
Figure 1D:
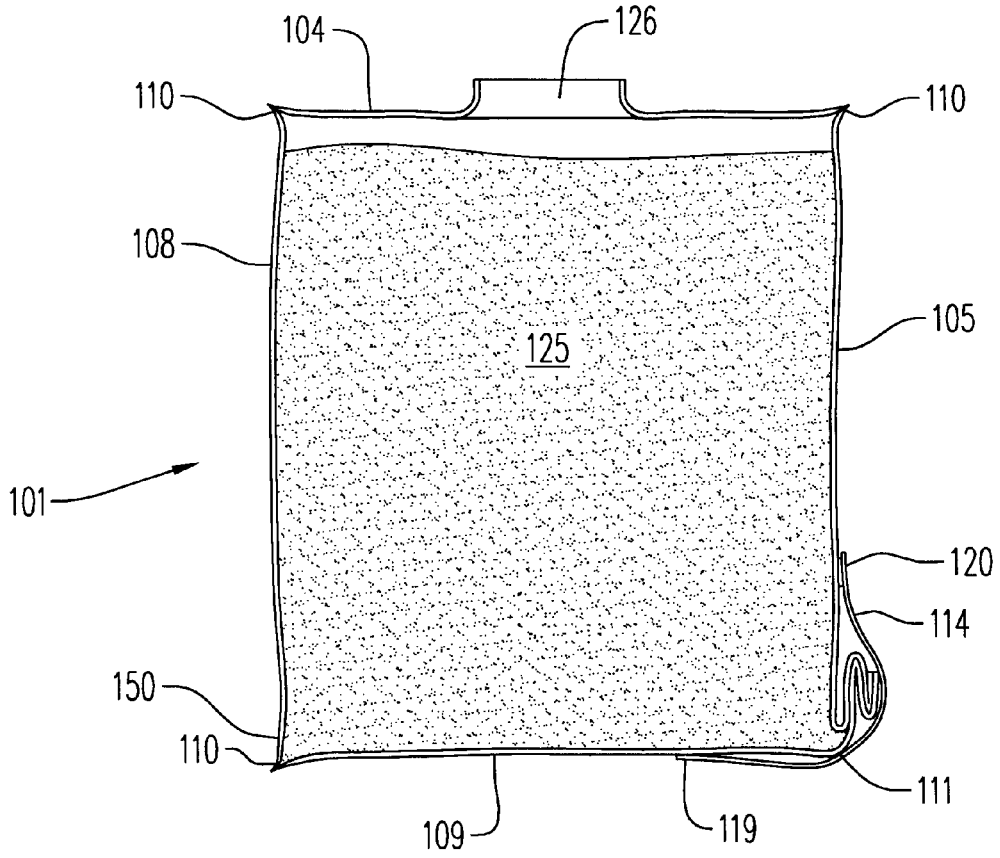
FIG. 1D is a sectional side view of the container of FIG. 1A in the pre-dispensing condition.

In accordance with the preferred embodiment of the present invention, a soft container 101 for storing and handling flowable dry goods and a system 102 for handling and discharging the goods therefrom is described and depicted in FIGS. 1A through 10.

The container is preferably constructed of a durable nylon reinforced polyethylene fabric, although any similarly durable, strong, and flexible sheet material may be substituted. The container comprises six panels; top panel 104, front panel 105, right side panel 106, left side panel 107, back panel 108, and bottom panel 109. The top, side and front and back panels are preferably all sewn together at their edges for their entire lengths, although gluing or hot-sealing might be satisfactory, so long as the seams 110 are at least as strong as the fabric itself. The bottom panel is fully sewn along its edges with the side and back panels, but is not attached to the front panel at the front-bottom edge 111. This is a key element of the invention. The container further comprises a funnel-shaped discharge chute 113 and a rectangular resealing flap 114, both made of the same fabric material. The chute includes a top wall 115 and a bottom wall 116, with the top wall being an extension of fabric from the front panel and the bottom panel. The top and bottom walls are sewn together at their side edges 117, but not at the front edge 111, which thereby forms the discharge opening when the container is lifted as depicted in FIGS. 4A through 5C. Initially though, the chute is folded as can best be seen in FIGS. 2A through 2C.

Figure 1E:
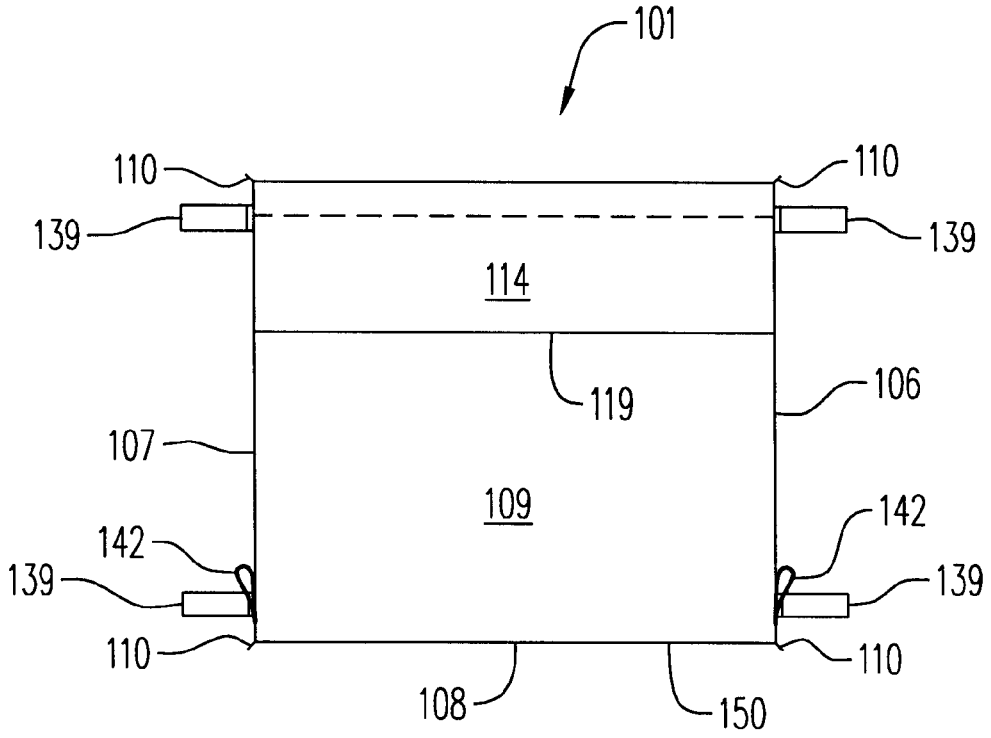
FIG. 1E is a bottom view of the container of FIG. 1A in the pre-dispening condition.

Shown in FIG. 1E, the resealing flap is sewn from side to side at its rear edge 119 to the bottom panel 109. At its front edge 120, the flap includes a female "velcro" strip 122. The front panel of the container includes an upper male "velcro" strip 123 and a lower male "velcro" strip 124 affixed horizontally there-across. The flap is thus adapted to extend from the bottom panel, across the container's front-bottom edge 111, over the folded chute, and to be attached to the upper male "velcro" strip before the container is filled with the dry goods. This maintains the container in the shape of a near-perfect orthogonal hexahedron, which is most efficient for transportation and storage. It can be readily appreciated that the flap covers and secures the chute in its closed position. and that the chute can be repeatedly resecured in the closed position by the flap in combination with the upper male "velcro" strip.

The container 101 of the Figures is shown in FIGS. 1A through 1E already filled with flowable dry goods 125. The top panel has an inlet opening 126 through which the goods have previously been deposited. This filled container may be placed on a pallet for normal handling, or can be lifted and transported by means of the loading loops 127 at the upper corners of the container. It is desirable to lift the filled container at these loops when moving the container from a truck or a pallet and onto the bed 128 of the dispensing system 102.

The dispensing system 102 comprises the aforementioned bed 128, two lift support members 130 standing on opposite sides of the bed, a flow restriction barrier 131, and an electro-hydraulic controller 132. The underside of the bed includes two slots 133 that mimic the size and location of standard pallet slots to allow a standard fork-lift or pallet jack to be used in transporting the system.

Each lift support member includes an upright post 134, a horizontal lift arm 135, and an emptying winch 136. The support members are positioned so as to straddle the container when it is properly positioned on the bed, with each front distal end 137 and rear distal end 138 of each horizontal lift arm being adjacent a lifting loop 139, four of which are affixed to and positioned midway up the side edges of the container. After so positioning the container on the bed, with its front-bottom edge 111 up against the flow restriction barrier 131 which extends across the forward edge 140 of the bed, the lifting loops are fitted over the distal ends.

Figure 9:
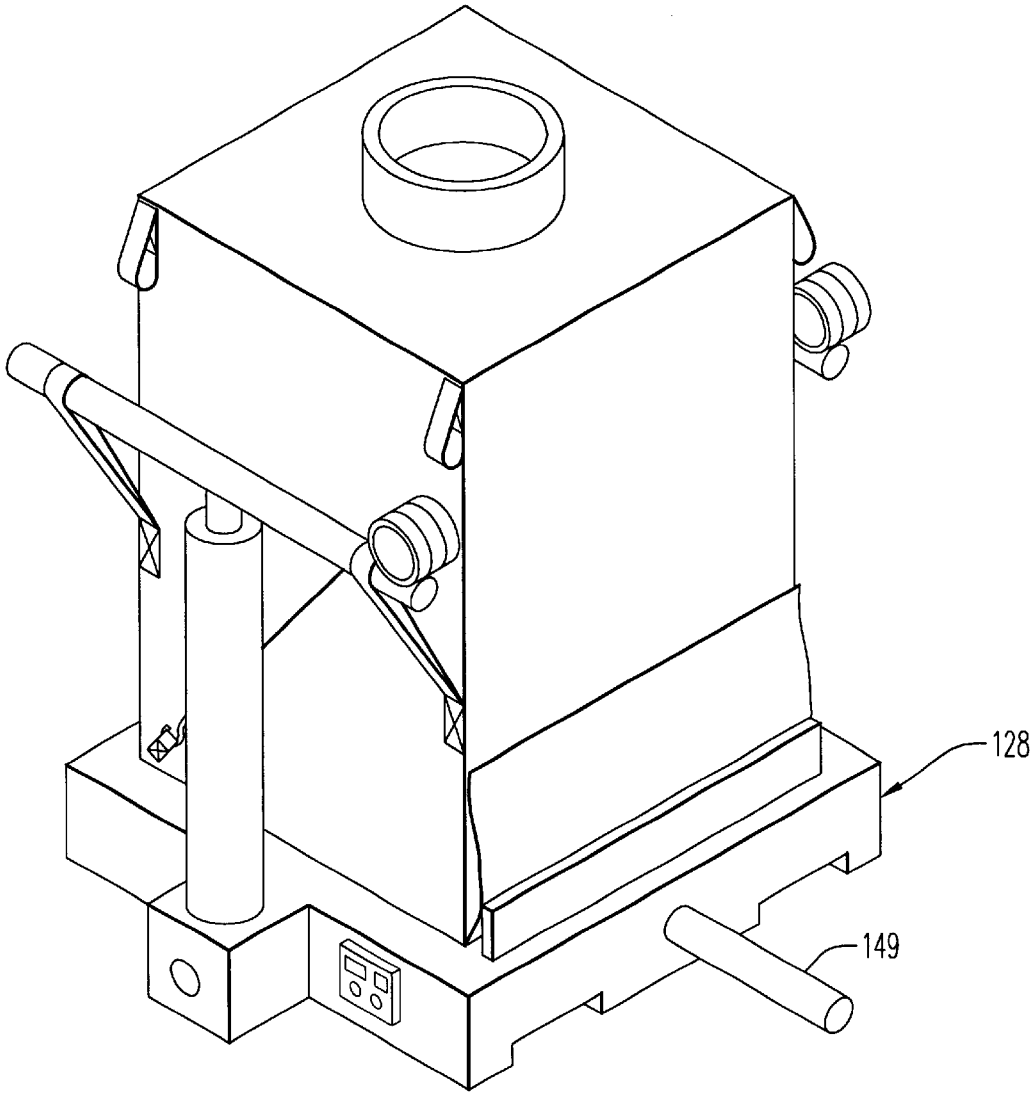
FIG. 9 is a perspective view of the container and system of FIG. 1A with the front-moving push/pull arm extended.
Figure 10:
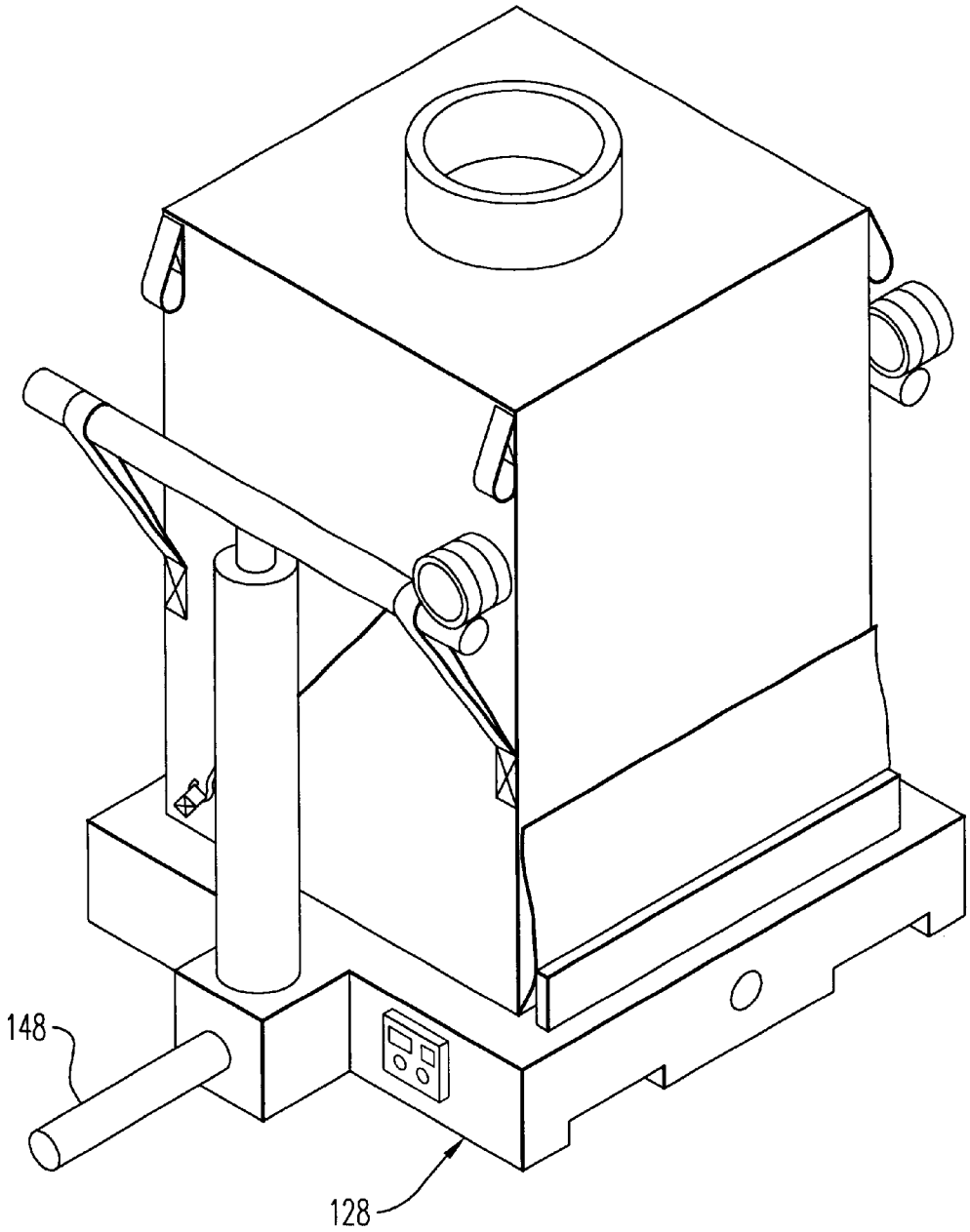
FIG. 10 is a perspective view of the container and system of FIG. 1A with the side-moving push/pull arm extended.

The emptying winch 136 of each support arm is affixed toward the front distal end 137 of each horizontal lift arm, and has a retractable winch line 141 extending therefrom. The container has two winching loops 142; each affixed at the rear-bottom corner 143 of each side panel. Hooks 144 at the ends of the winch lines 141 are attached to the winching loops such that the winch lines lie diagonally across each side panel from the rear-bottom corner toward the front-upper corner 145. The filled container may be stored and handled as is now attached to the dispensing system, or moved to various locations about a warehouse for remote discharge. The bed is also equipped with retractable wheels 147, and has a side-moving push/pull arm 148 and a forward-moving push/pull arm 149, which each can be moved against a stationary object and extended or retracted horizontally to push or pull the dispensing system and thereby locate it more accurately than may be done with a fork-lift. This is best shown in FIGS. 9 and 10.

Figure 2A:
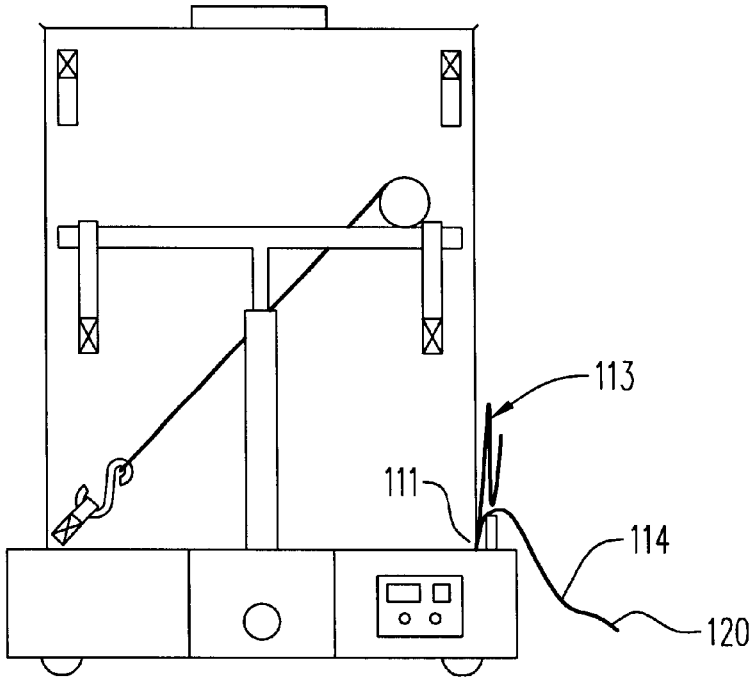
FIG. 2A is a side view of the container and system of FIG. 1A with the resealing flap opened and the chute still folded.
Figure 2B:
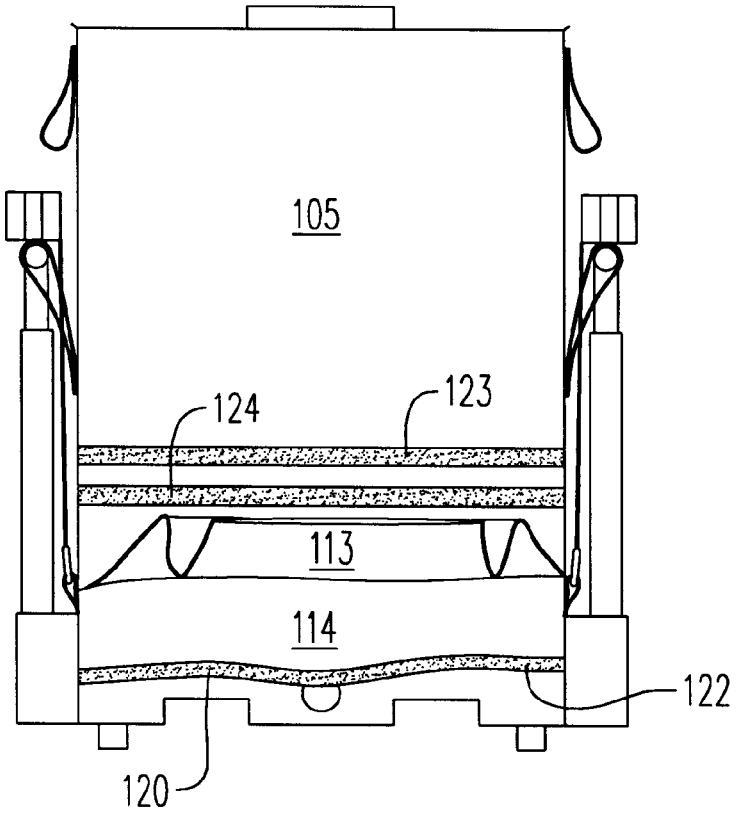
FIG. 2B is a front view of the container and system of FIG. 1A with the resealing flap opened and the chute still folded.
Figure 2C:
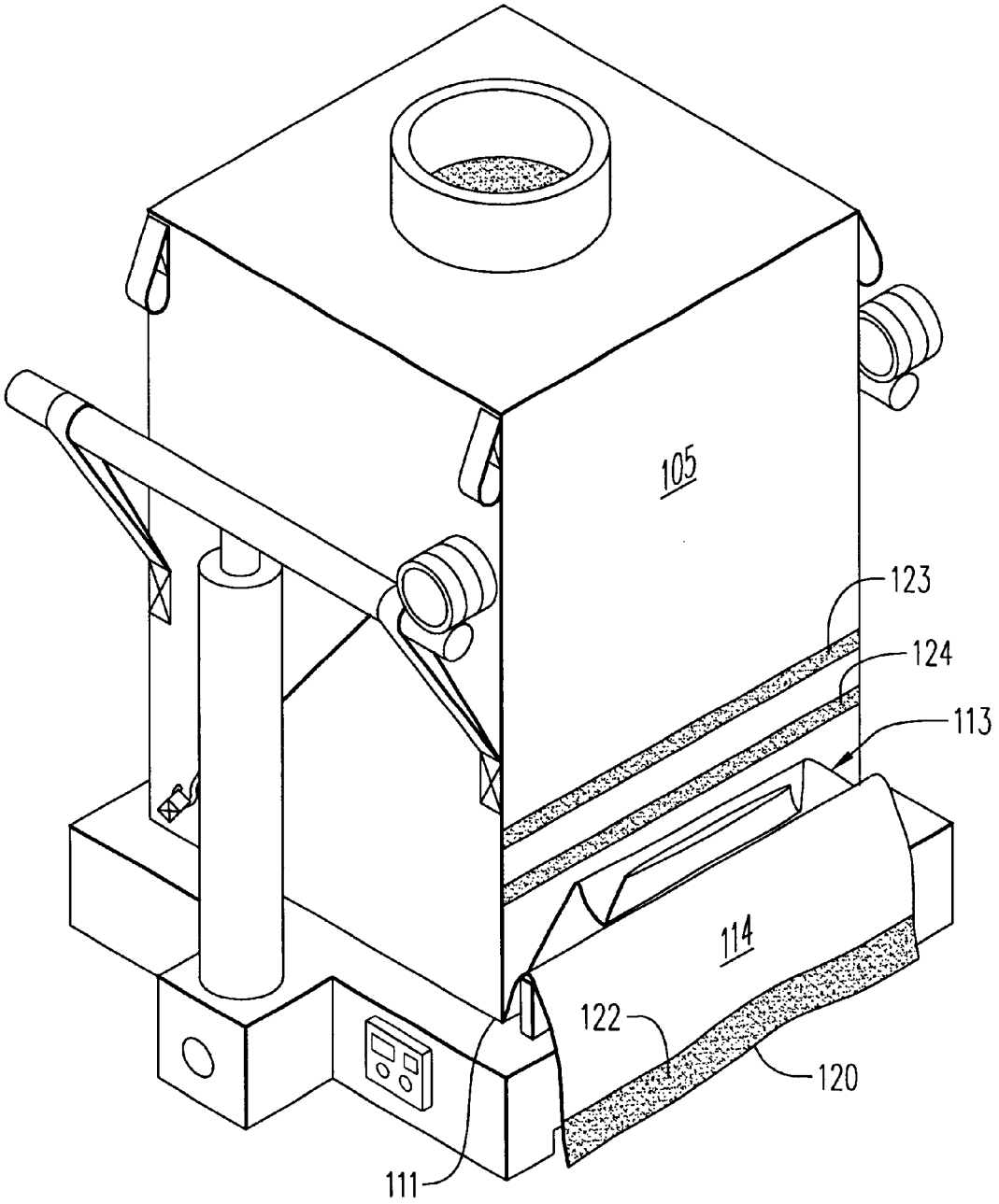
FIG. 2C is a perspective view of the container and system of FIG. 1A with the resealing flap opened and the chute still folded.
Figure 3A:
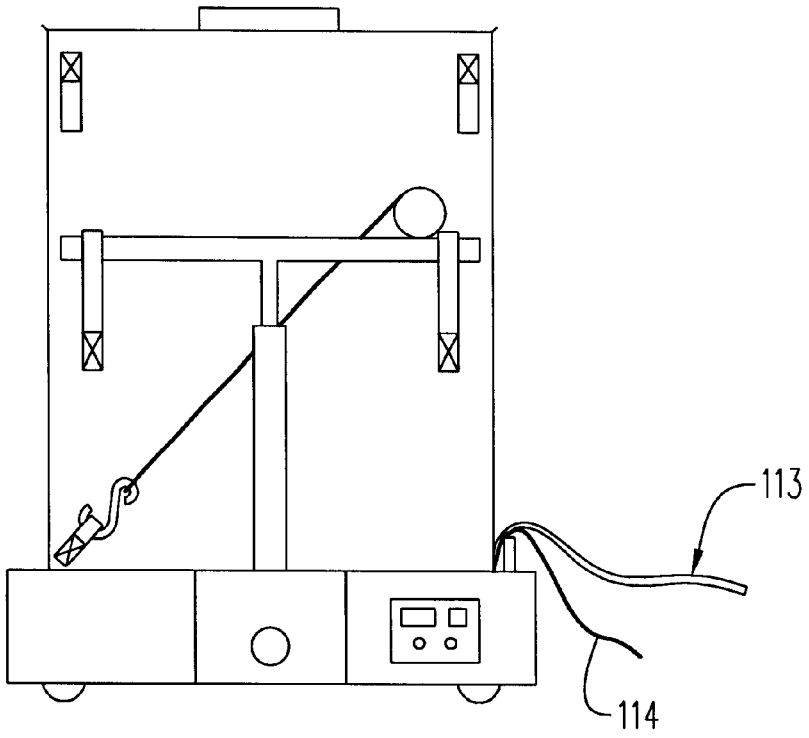
FIG. 3A is a side view of the container and system of FIG. 1A with the dispensing chute unfolded and extended and the container unlifted.
Figure 3B:
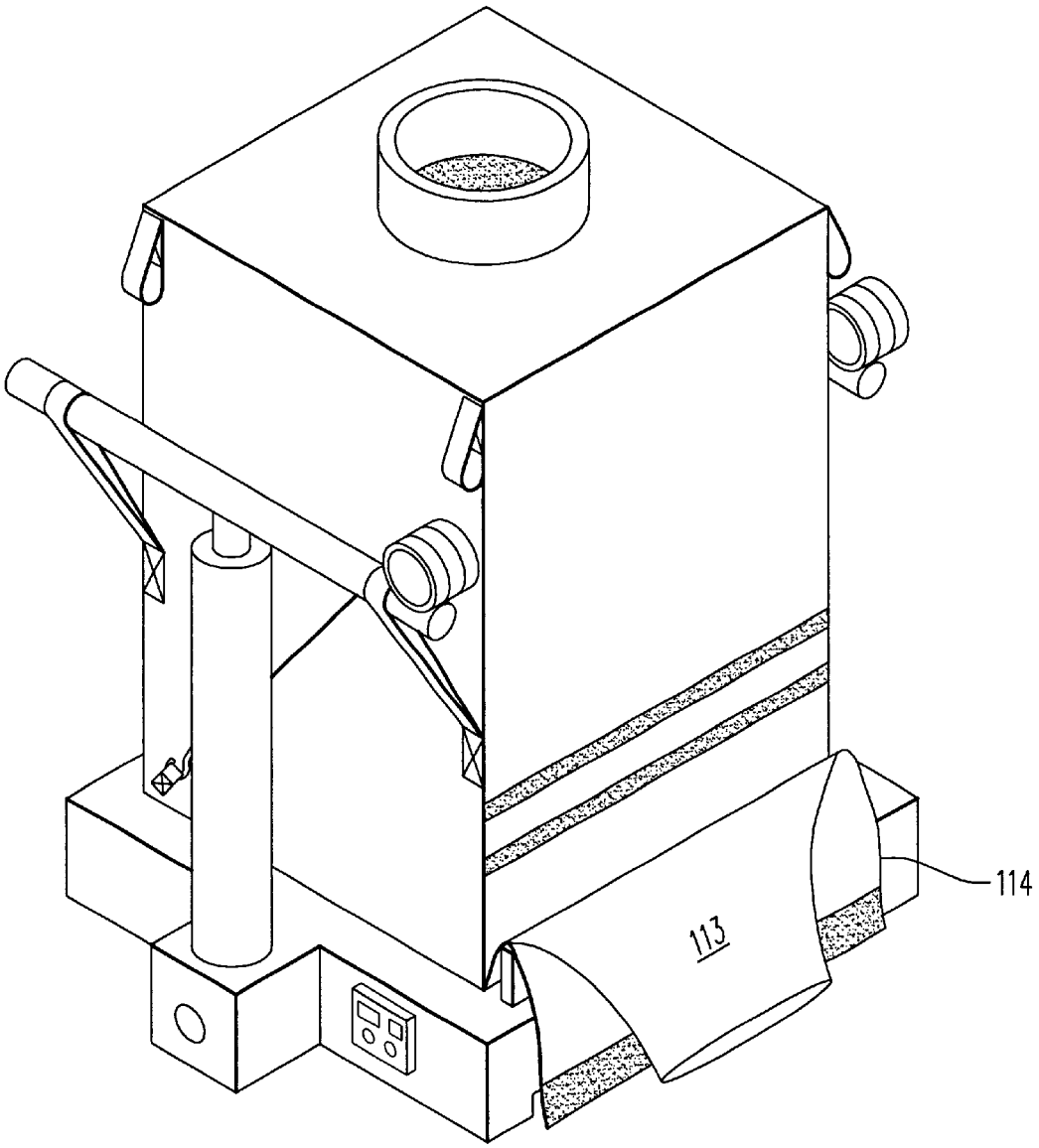
FIG. 3B is a perspective view of the container and system of FIG. 1A with the dispensing chute unfolded and extended and the container unlifted.

With the filled container in position for discharging goods as shown in FIGS. 1A through 1D, the resealing flap 114 is peeled from the upper "velcro" strip 123 as shown in FIGS. 2A through 2C, and the discharge chute 113 is extended as shown in FIGS. 3A and 3B. The flow restriction barrier 131 pinches the chute to maintain it in a closed confriguration and no goods can escape.

The controller 132 is then triggered to begin hydraulically raising the horizontal lift arms 135 up and away from the bed 128 to thereby lift the container by the lifting loops 139. As the front-bottom edge 111 of the container is moved from the flow restriction barrier 131, the chute opens as shown in FIGS. 4A through 4D, and goods begin to flow through the chute at a rate which varies proportionally with the height to which the container is lifted from the bed.

Figure 4A:
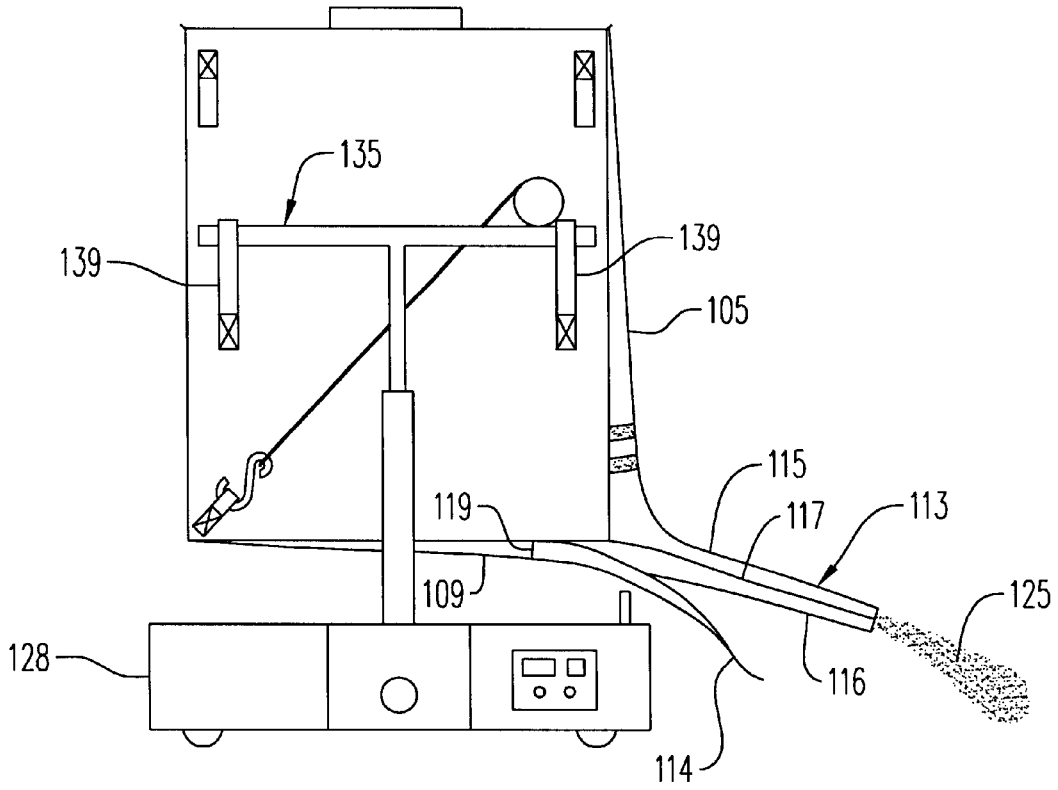
FIG. 4A is a side view of the container and system of FIG. 1A with the container lifted and the dispensing chute opened for dispensing therefrom.
Figure 4B:
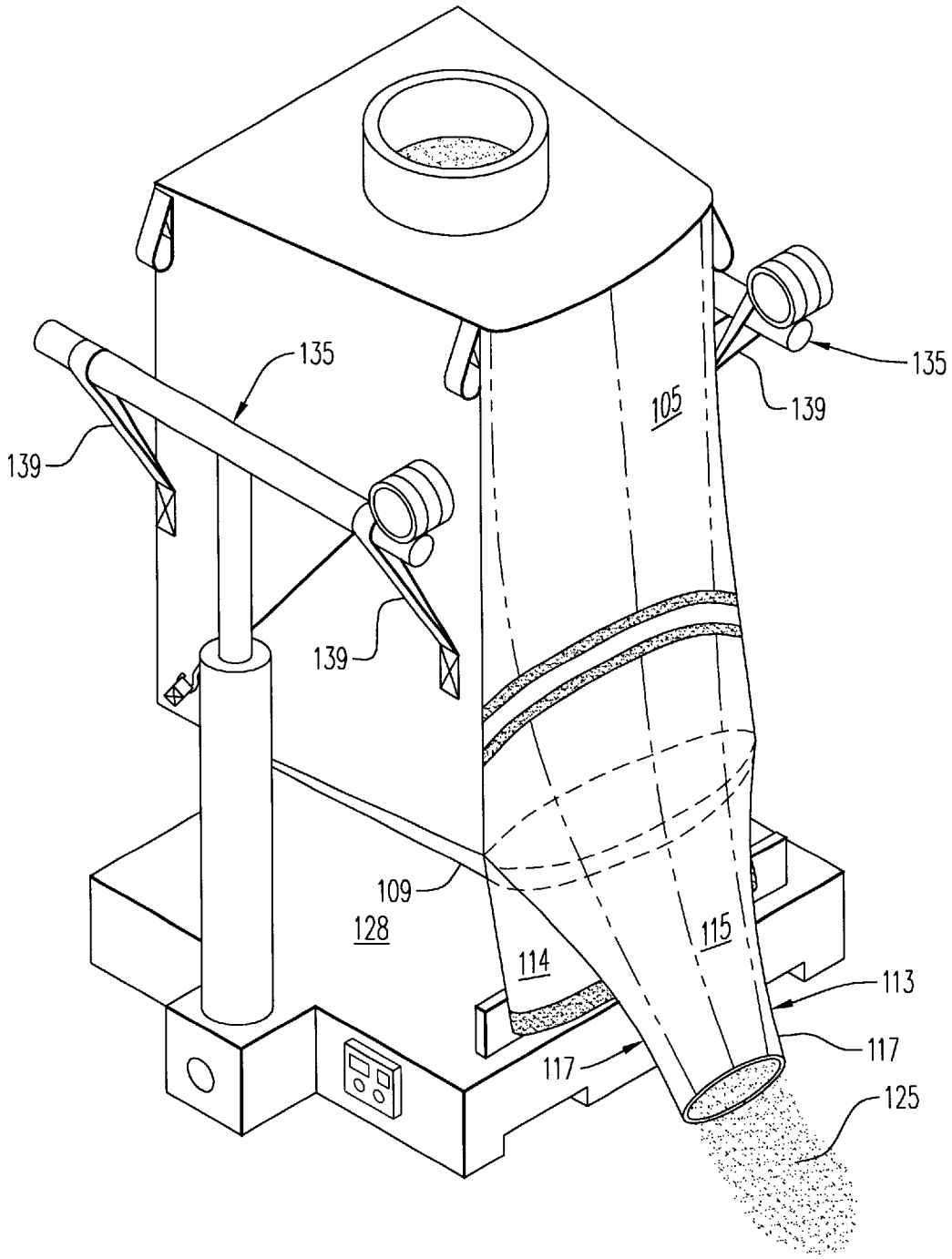
FIG. 4B is a perspective view of the container and system of FIG. 1A with the container lifted and the dispensing chute opened for dispensing therefrom.
Figure 4C:
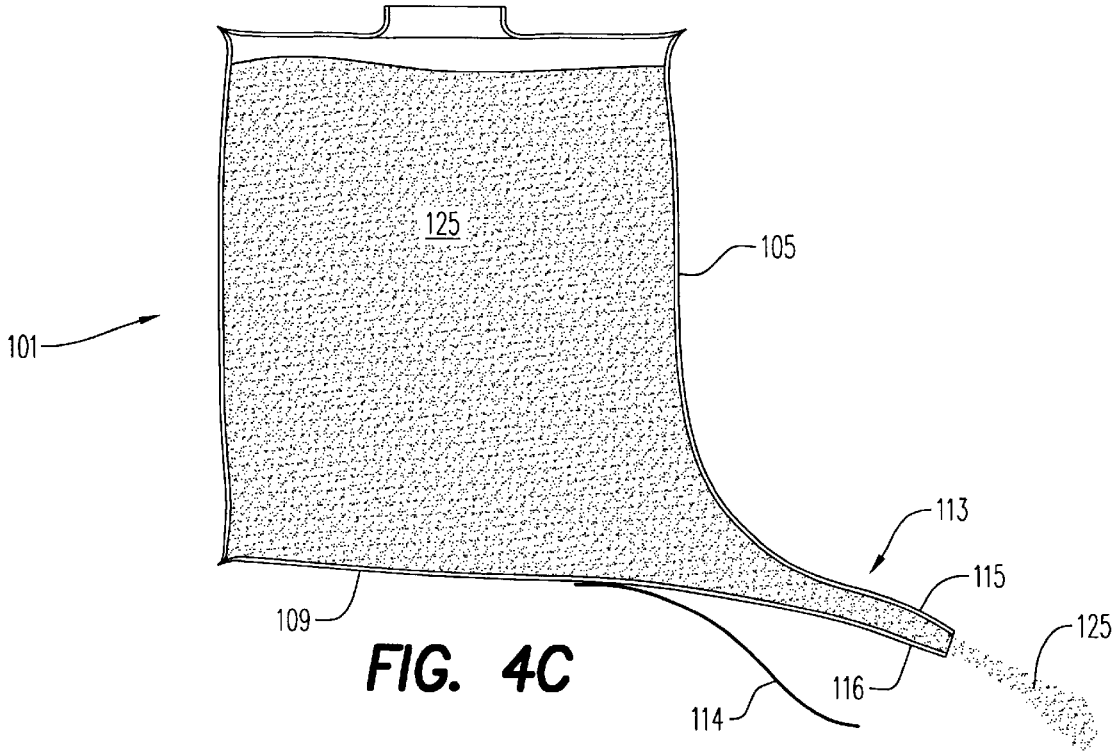
FIG. 4C is a sectional side view of the container of FIG. 1A with the container lifted and the dispensing chute opened for dispensing therefrom.
Figure 4D:
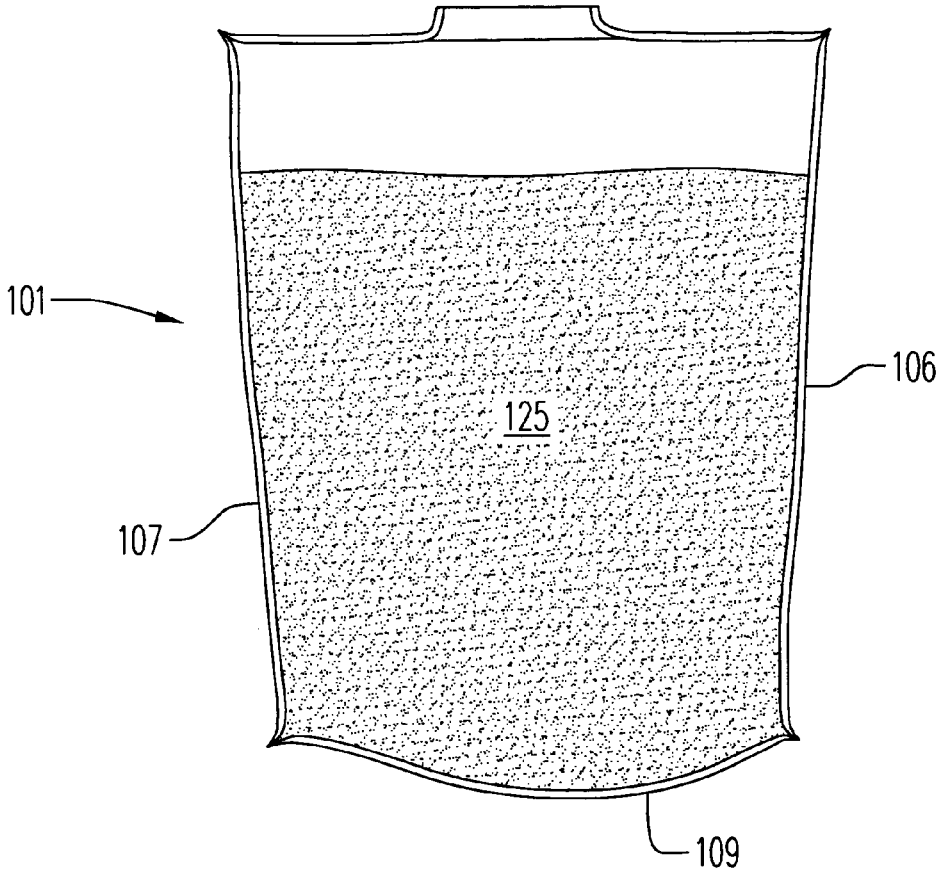
FIG. 4D is a sectional front view of the container of FIG. 1A with the container lifted and the dispensing chute opened for dispensing therefrom.
Figure 5A:
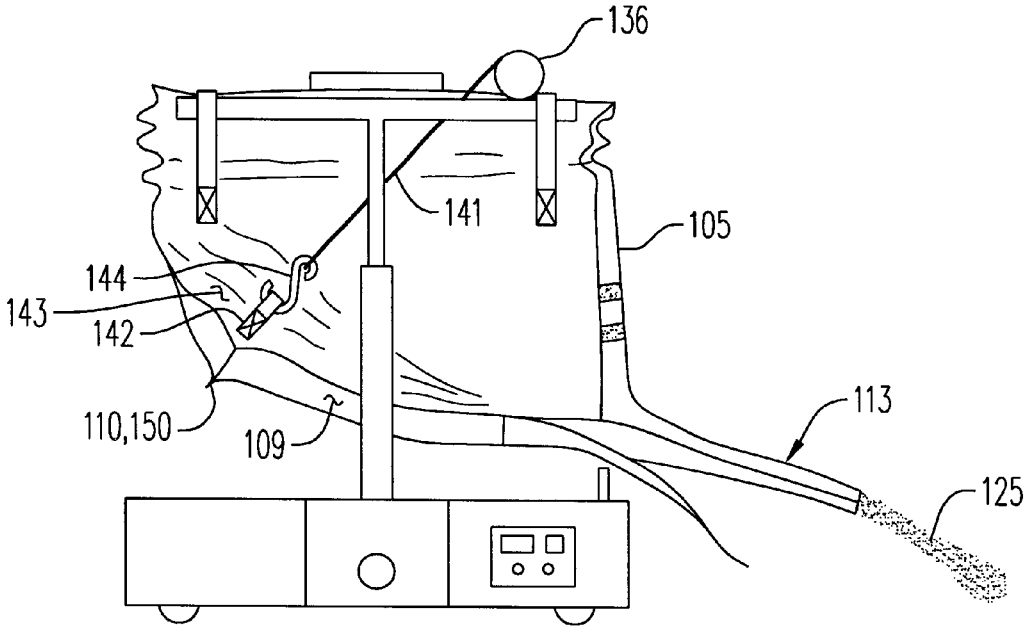
FIG. 5A is a side view of the container and system of FIG. 1A with the winching line retracted to empty the container.
Figure 5B:
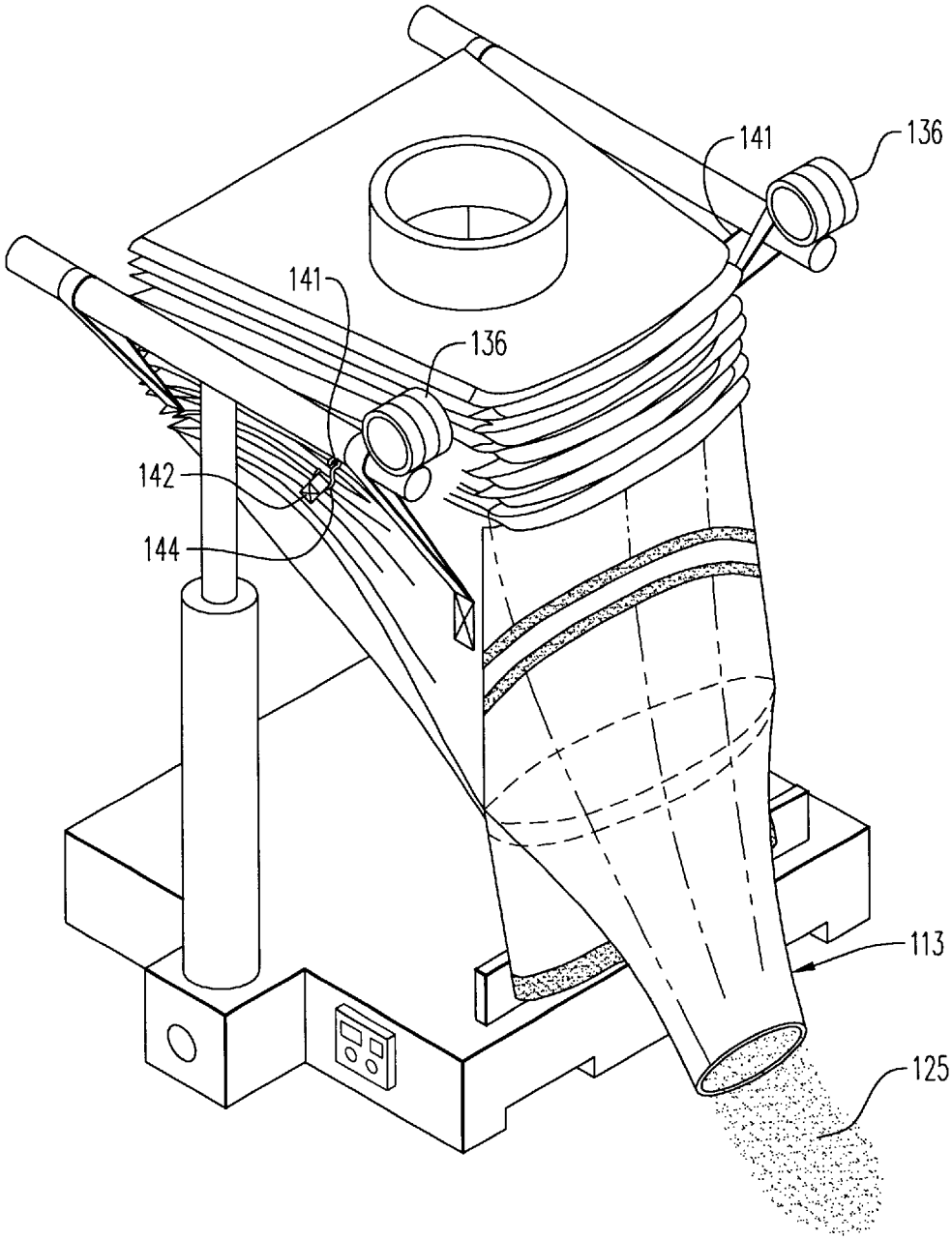
FIG. 5B is a perspective view of the container and system of FIG. 1A with the winching line retracted to empty the container.
Figure 5C:
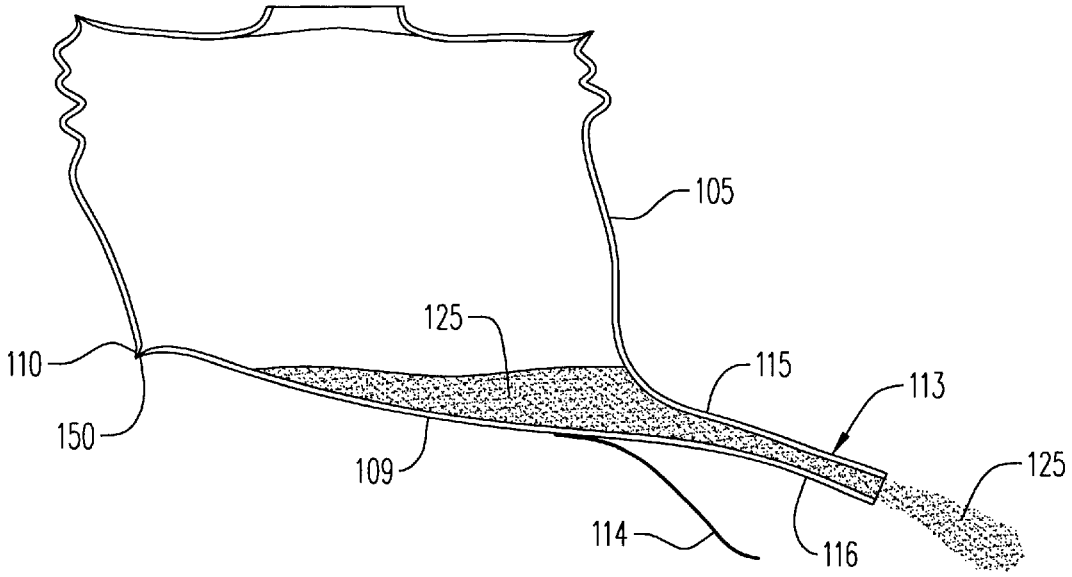
FIG. 5C is a sectional side view of the container of FIG. 1A with the winching line retracted to empty the container.

To best appreciate the mechanism by which the chute is opened and by which its opening size is controlled, one should look at FIGS. 4C and 4D. It will be noted that the unsewn front-bottom edge 111 allows the front panel 105 to bow forwardly at that edge and the bottom panel 109 to bow downwardly, opening the chute as the side walls collapse inward. As the container is incrementally lifted from the bed, the bowing incrementally increases and the chute opening expands. This effect additionally allows the side and bottom panels to slope downwardly toward the chute, improving flow and breaking up any goods which might have caked and clumped. Once the container is totally lifted from the bed, the chute achieves its maximum opening size and the rate of flow is maintained at its maximum rate until the bag is near empty or is re-lowered. As the goods are being discharged, an electronic scale within the controller 132 monitors and displays the dispensed and remaining weight of the goods. The controller may be programmed to terminate the discharge at a pre-selected weight by lowering the container as that weight is approached.

Figure 6A:
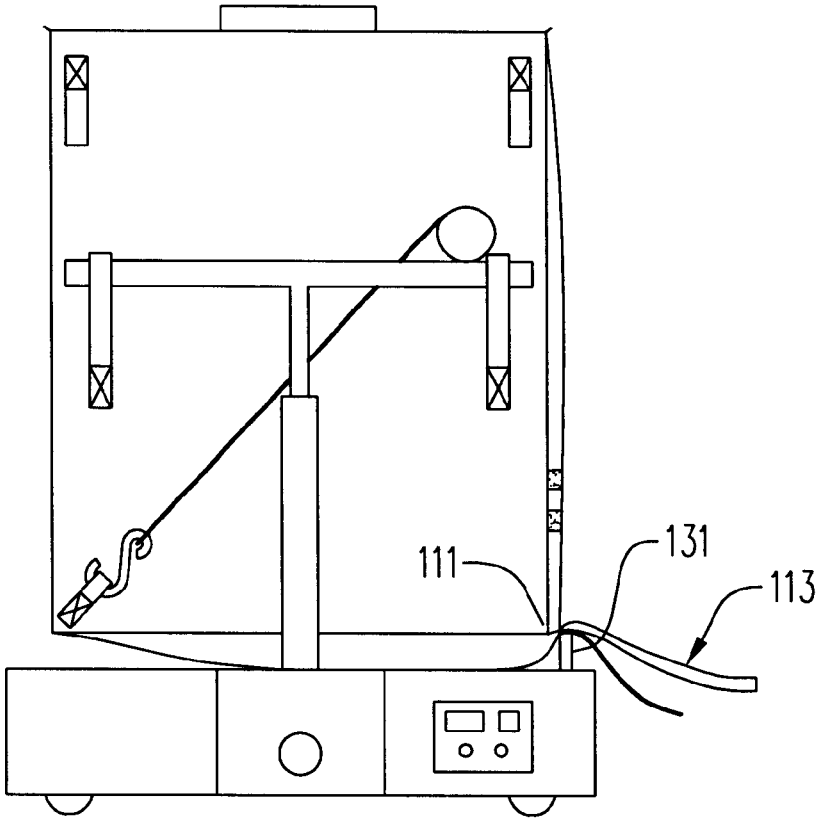
FIG. 6A is a side view of the container and system of FIG. 1A with the container lowered and the dispensing chute pinched by the flow restriction barrier.
Figure 6B:
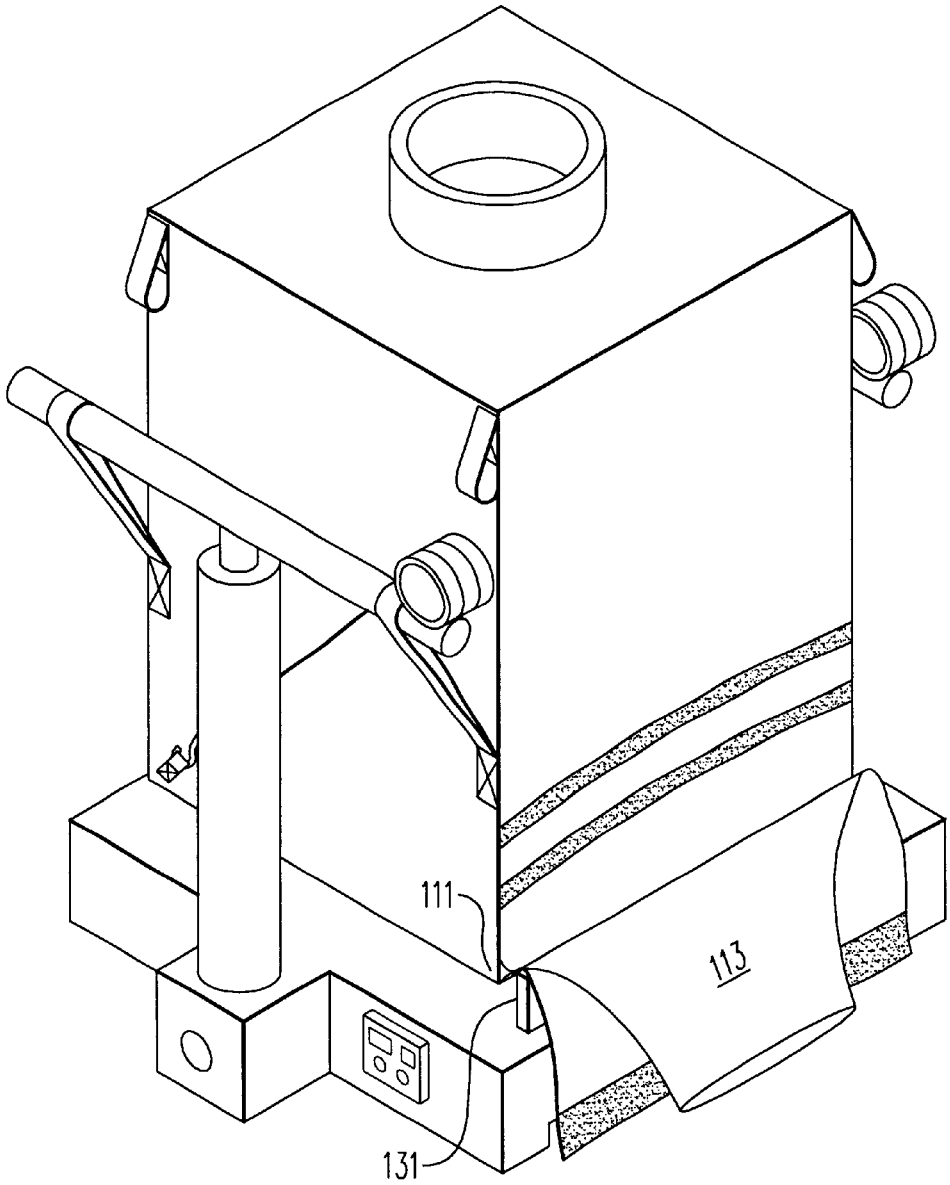
FIG. 6B is a perspective view of the container and system of FIG. 1A with the container lowered and the dispensing chute pinched by the flow restriction barrier.
Figure 7A:
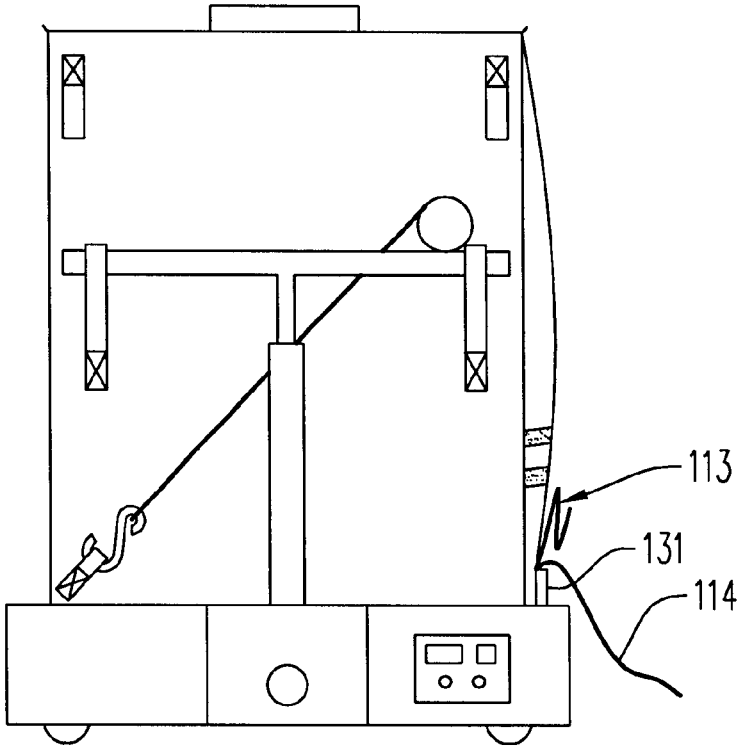
FIG. 7A is a side view of the container and system of FIG. 1A with the chute refolded.
Figure 7B:
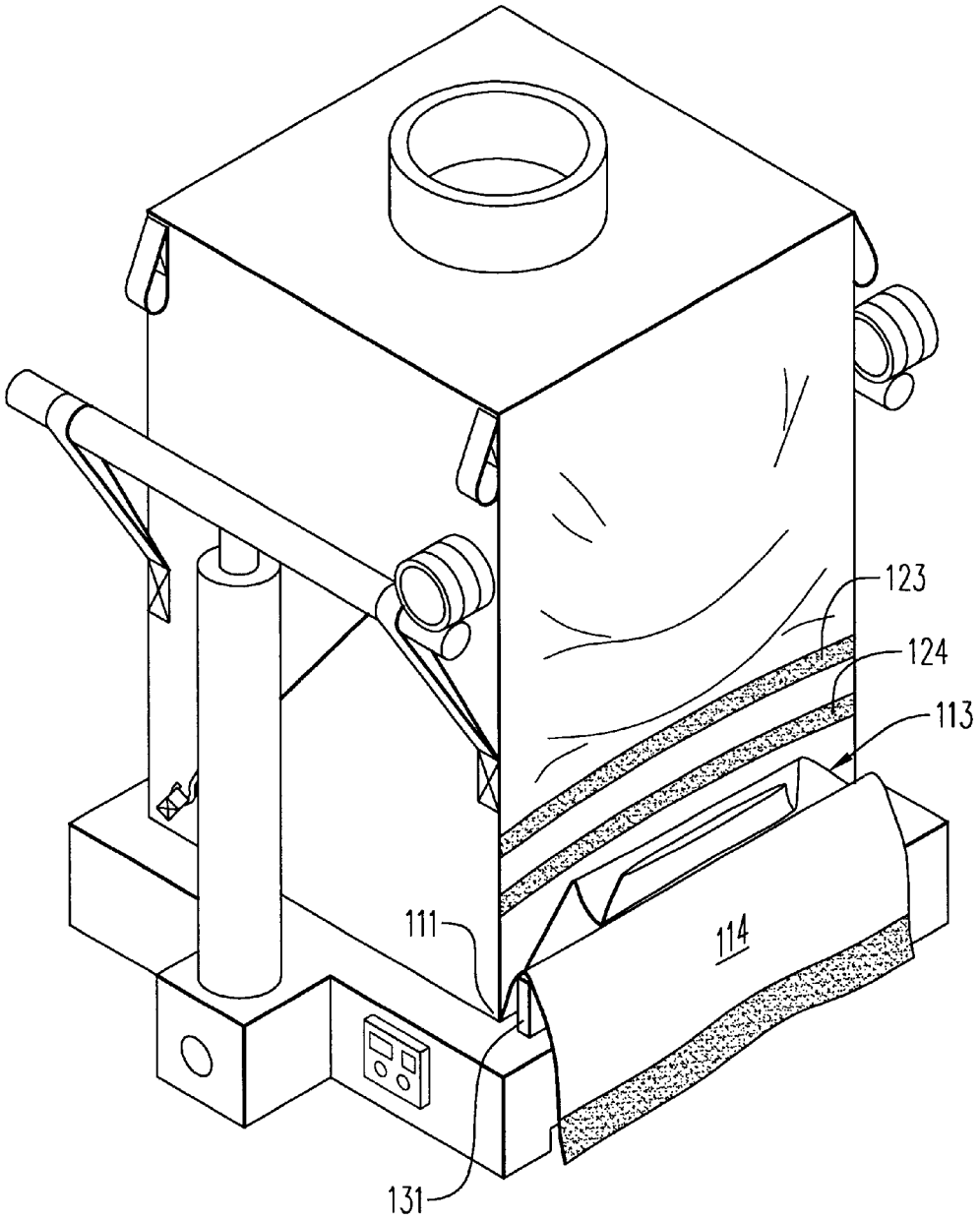
FIG. 7B is a perspective view of the container and system of FIG. 1A with the chute refolded.
Figure 8A:
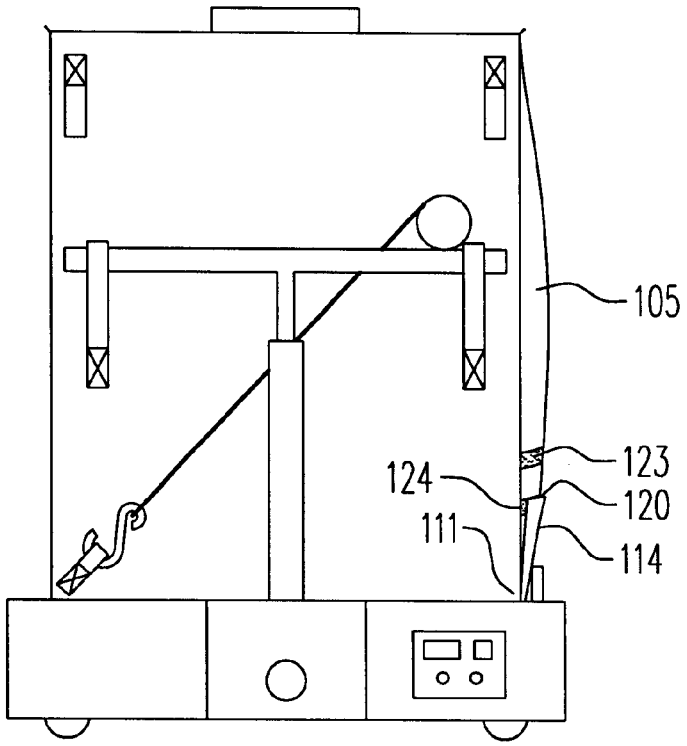
FIG. 8A is a side view of the container and system of FIG. 1A with the resealing flap resealed to the lower "velcro" strip.
Figure 8B:
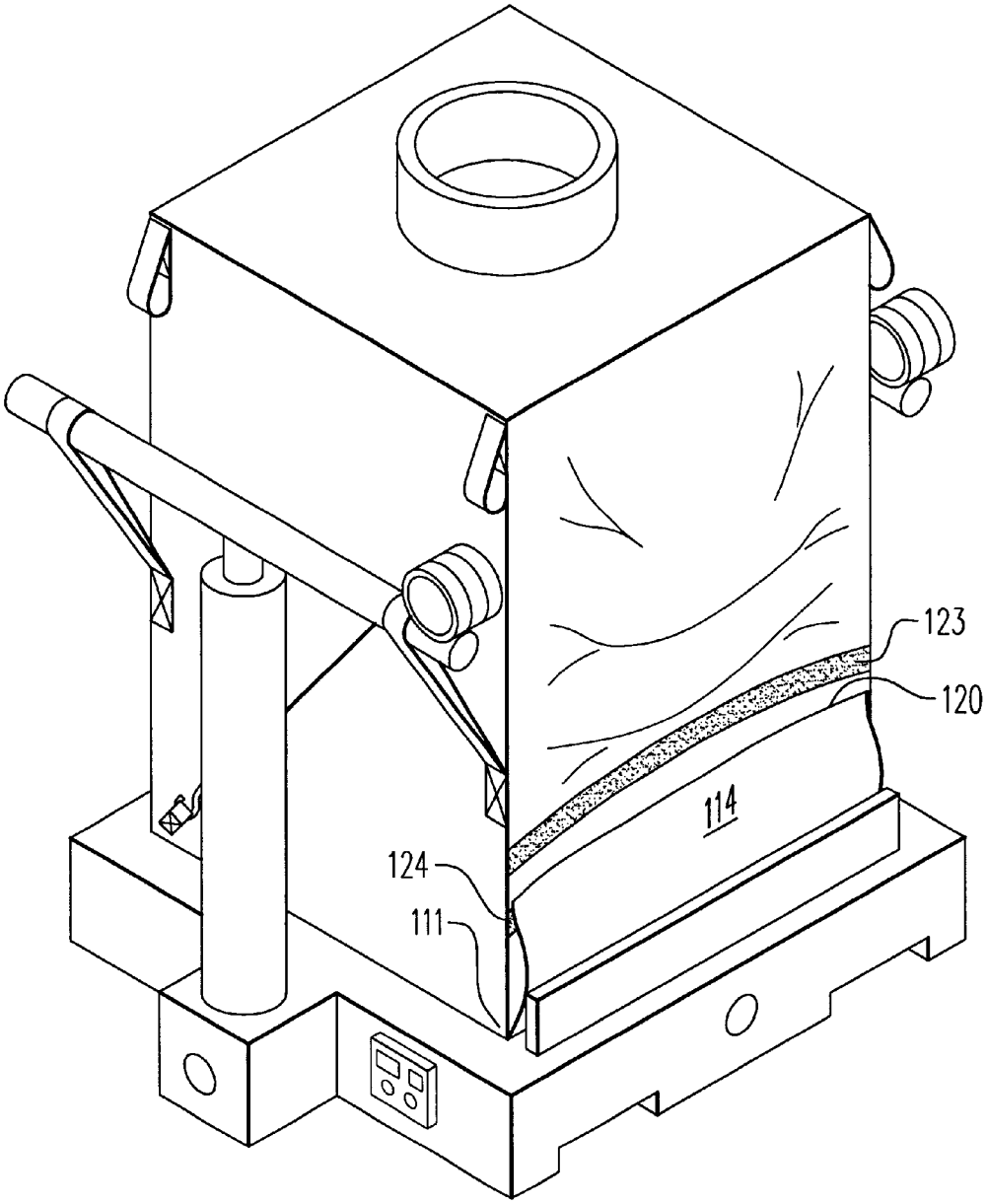
FIG. 8B is a perspective view of the container and system of FIG. 1A with the resealing flap resealed to the lower "velcro" strip.

If the flow rate from the chute is more than desired or if the full contents of the container are not to be discharged, the container is simply lowered against the bed to reduce the chute opening size and reduce the flow rate or further lowered against the flow restriction barrier 131, which pinches the chute shut to terminate flow as shown in FIGS. 6A and 6B. The container may now be resealed and restored for later use of the remaining contents. It should be appreciated though, that the bowing of the front and bottom panels will not be completely removed by the lowering of the container, and the partially discharged container will no longer have a near perfect orthogonal hexahedral shape. So with the chute 113 refolded as shown in FIGS. 7A and 7B, and the resealing flap 114 pulled upwards and over the chute, the flap can no longer reach the upper "velcro" strip 123. However, the resealing flap can now be attached to the front panel 105 at the lower "velcro" strip 124 as shown in FIGS. 8A and 8B.

Should discharge of the container's entire contents be desired, the container will be maintained in the lifted position of FIGS. 4A through 4C until flow ceases. This will occur before the contents are entirely discharged, because the slope of the bottom panel is not sufficient to cause all of the goods towards the back panel to flow to the chute. The controller can now be activated, either manually or by automatically sensing the remaining weight, to retract the winch lines 141 into the winches 136 and thereby pull the back bottom edge 150 of the container upward and forward, increasing the slope of the bottom panel towards the chute, and causing the remaining goods to discharge.

Once the container is completely emptied, it can be washed, resealed as originally, and reused indefinitely.

It should be appreciated by those skilled in the art that the disclosed is simply the preferred of many possible embodiments of the invention, and therefore, the scope of the invention should only be limited by the following claims.

What is claimed is:

1. A method for dispensing flowable dry goods comprising the steps of:

providing a container having an upper portion defining a compartment and a bottom wall portion defining an opening;

filling said compartment with flowable dry goods;

supporting said container on a surface engaging said bottom wall portion to close said opening and thereby prevent gravity-induced discharge of said dry goods through said opening;

raising said container off of said surface to expose said opening and thereby induce discharge of a portion of the dry goods through said opening;

lowering said container onto said surface to close said opening and thereby terminate said discharge of said dry goods through said opening; and wherein said containers further comprise:

a rectangular top wall;

two opposing side walls depending therefrom;

opposing front and back walls extending between said opposing side walls;

each of said walls having four edges;

each of said edges connected along its entirety in an orthogonal configuration to that of said other walls to which it is adjacent;

and wherein said bottom wall portion opposes said top wall and having a back edge adjacent said back wall, two side edges each adjacent one of said side walls, and a front edge adjacent said front wall said back and side edges connected along their entireties in orthogonal configuration to that of said walls to which each is adjacent, but said front edge is substantially unconnected to said adjacent front wall;

and wherein raising said container induces said substantially unconnected edge to spread to thereby from said opening and induce said discharge; and lowering said container closes said opening to thereby terminate said discharge.

2. A system for handling containers of flowable dry goods, said containers comprising:

an upper portion defining a compartment for retaining said dry goods;

a bottom wall portion for supporting said container on a surface, said bottom wall portion defining a discharge opening allowing gravity-induced discharge of said dry goods from said compartment;

said system comprising lift means for either raising said container from said surface to expose said opening to induce said discharge of said dry goods, or lowering said container onto said surface to close said opening to terminate said discharge of said dry goods; and wherein said container further comprise:

a rectangular top wall;

two opposing side walls depending therefrom;

opposing front and back walls extending between said opposing side walls, each of said walls having four edges, each of said edges connected along its entirety in an orthogonal configuration to that of said other walls to which it is adjacent; and said bottom wall portion opposes said top wall and has a back edge adjacent said back wall, two side edges each adjacent one of said side walls, and a front edge adjacent said front wall, said back and side edges connected along their entireties in orthogonal configuration to that of said walls to which each is adjacent, but said front edge being substantially unconnected to said adjacent front wall; and said means for either raising or lowering said container induces said substantially unconnected edge to spread when said container is raised to thereby open said discharge opening and induce said discharge, and to close when said container is lowered to thereby terminate said discharge.

3. The system of claim 2 wherein:

said container further comprises a flexible chute extendable from said discharge opening into a discharge position whereby said goods are dispensable therethrough; and said system further comprises a flow restriction barrier to pinch said flexible chute closed when said container is so lowered.

4. The system of claim 2 further comprising means for emptying said container as said goods within become nearly depleted, by inducing said nearly depleted goods to flow toward and through said discharge opening.

5. The system of claim 2 further comprising pallet-mimicking slots to allow the system to be handled by a standard fork lift or pallet jack.

6. The system of claim 2 further comprising integral positional adjustment means for moving said system toward or from a stationary object.

7. A container for holding and dispensing flowable dry goods and comprising:

an upper portion defining a compartment for retaining the dry goods;

a bottom portion for supporting a container on a surface, said bottom portion defining a discharge opening;

an opening defined in said bottom wall portion and arranged such that lifting said container off of the surface provides a gravity induced discharge of the dry goods through said opening, and subsequent lowering of said bottom wall portion onto the surface covers said opening by the surface to terminate discharge of the dry goods;

a chute having a chute opening, extendible transversely of said bottom wall portion, said chute being flexible for closing against said upper portion of said container when said container is on the surface;

cover means projecting from said bottom wall portion and extendible over said opening; and wherein said container is collapsible into a substantially flat configuration.

8. A container according to claim 7 wherein said cover means is a flexible flap.

9. A container according to claim 7 wherein said cover means is shaped and arranged for covering said closed chute with said closed chute against said upper portion of said container.

10. A container according to claim 9 including securement means for securing said cover means and said chute against said upper portion.

11. A container according to claim 10 wherein said securement means is adapted to secure said cover means and said chute against variable positions on said upper portion.

12. A container for holding and dispensing flowable dry goods and comprising:

an upper portion defining a compartment for retaining the dry goods;

a bottom wall portion shaped and arranged to contact a support surface and thereby support said container thereon;

an opening defined in said bottom wall portion and arranged such that lifting said container off of the surface provides a gravity induced discharge of the dry goods through said opening, and subsequent lowering of said bottom wall portion onto the surface covers said opening by the surface to terminate discharge of the dry goods;

a chute having a chute opening extendible transversely of said bottom wall portion, said chute being flexible for closing against said upper portion of said container when said container is on the surface; and cover means projecting from said bottom wall portion and extendible over said opening.

13. A container according to claim 12 wherein said cover means is shaped and arranged for covering said closed chute with said closed chute against said upper portion of said container.

14. A container according to claim 13 wherein said cover means is a flexible flap.

15. A container according to claim 13 including securement means for securing said cover means and said chute against said upper portion.

16. A container according to claim 15 wherein said securement means is adapted to secure said cover means and said chute against variable positions on said upper portion.

17. A container for holding and dispensing flowable dry goods and comprising:

an upper portion defining a compartment for retaining the dry goods;

a bottom wall portion shaped and arranged to contact a support surface and thereby support said container thereon;

an opening defined in said bottom wall portion and arranged such that lifting said container off of the surface provides a gravity induced discharge of the dry goods through said opening, and subsequent lowering of said bottom wall portion onto the surface covers said opening by the surface to terminate discharge of the dry goods;

cover means projecting from said bottom wall portion and extendible over said opening;

a chute having a chute opening extendible transversely of said bottom wall portion, said chute being flexible for closing against said upper portion of said container when said container is on the surface; and lift means for either raising said container from the surface to open said discharge opening to induce said discharge of the dry goods through said opening, or lowering said container onto the surface to close said opening to terminate said discharge of the dry goods.

18. A container according to claim 17 wherein said cover means is shaped and arranged for covering, said closed chute with said closed chute against said upper portion of said container.

19. A container according to claim 18 including securement means for securing said cover means and said chute against said upper portion.

20. A container according to claim 19 wherein said securement means is adapted to secure said cover means and said chute against variable position on said upper portion.

21. A container according to claim 20 wherein said cover means is a flexible flap.

22. A container for holding and dispensing flowable dry goods and comprising:

an upper portion defining a compartment for retaining the dry goods;

a bottom wall portion shaped and arranged to contact a support surface and thereby support said container thereon;

an opening defined in said bottom wall portion and arranged such that lifting said container off of the surface provides a gravity induced discharge of the dry goods through said opening, and subsequent lowering of said bottom wall portion onto the surface covers said opening by the surface to terminate discharge of the dry goods; and a chute projecting from said opening and defining a chute opening extendible transversely from said bottom wall portion, said chute being flexible for closing against said upper portion of said container when said container is on the surface.

23. A container according to claim 22 including securement means for securing said chute against said upper portion.

24. A container according to claim 23 wherein said securement means is adapted to secure said chute against variable positions on said upper portion.

25. A container according to claim 22 including lift means for either raising said container from said surface to open said discharge opening to induce said discharge of the dry goods through said opening, or lowering said container onto said surface to close said opening to terminate said discharge of the dry goods.

26. A container according to claim 25 wherein said chute is flexible for closing against said upper portion of said container when said container is on the surface.

27. A container according to claim 26 including securement means for securing said chute against said upper portion.

28. A container according to claim 27 wherein said securement means is adapted to secure said chute against variable positions on said upper portion.

29. A container for holding and dispensing flowable dry goods and comprising:

an upper portion defining a compartment for retaining said dry goods;

a bottom wall portion for supporting said container on a surface, said bottom wall portion defining a discharge opening allowing gravity-induced discharge of said dry goods from said compartment;

lift means for either raising said container from said surface to expose said opening to induce said discharge of said dry goods, or lowering said container onto said surface to close said opening to terminate said discharge of said dry goods; and wherein said upper portion comprises:

a rectangular top wall;

two opposing side walls depending therefrom;

opposing front and back walls extending between said opposing side walls;

each of said walls having four edges;

each of said edges connected along its entirety in an orthogonal configuration to that of said other walls to which it is adjacent;

wherein said bottom wall portion opposes said top wall and has a back edge adjacent said back wall, two side edges each adjacent one of said side walls, and a front edge adjacent said front wall wherein said back and side edges are connected along their entireties in orthogonal configuration to that of said walls to which each is adjacent, but said front edge is substantially unconnected to said adjacent front wall; and wherein said means for either raising or lowering said container induces said substantially unconnected edge to spread when said container is raised to thereby open said discharge opening and induce said discharge, and to close when said container is lowered to thereby terminate said discharge.

30. The container of claim 29, wherein said side walls collapse inwardly adjacent said bottom wall portion when said container is raised, to thereby help to loosen any of said goods therebetween which have become caked.

31. The container of claim 29 wherein said bottom wall portion slopes downwardly toward said substantially unconnected front edge when said container is lifted, to thereby induce said goods to flow toward and through said discharge opening.

32. The container of claim 31, further comprising emptying means for increasing said downward slope of said bottom wall portion as said goods within become nearly depleted, thereby inducing said nearly depleted goods to flow toward and through said discharge opening.

33. The container of claim 29 further comprising a flexible chute extendable from said discharge opening into a discharge position whereby said goods are discharged there through.

34. The container of claim 33 further comprising a removable sealing flap adaptable in a first flap storage position to cover said front edge and to enclose and maintain said chute in a closed position, and adaptable in a flap dispensing position to liberate said chute and allow said chute to extend into said discharge position.

35. The container of claim 34 wherein said sealing flap is further adaptable in a second flap storage position to enclose said chute in said closed position when said substantially unconnected edge is spread.

36. the container of claim 35 wherein:

said side walls collapse inwardly adjacent said bottom wall portion when said container is raised, to thereby help to loosen any of said goods therebetween which have become caked;

said bottom wall portion slopes downwardly toward said substantially unconnected front edge when said container is raised, to thereby induce said goods to flow toward and through said discharge opening; and further comprising:

emptying means for increasing said downward slope of said bottom wall portion as said goods within become nearly depleted, thereby inducing said nearly depleted goods to flow toward and through said discharge opening.

* * * * *